US007905277B2

(12) United States Patent
Riondet et al.

(10) Patent No.: US 7,905,277 B2
(45) Date of Patent: Mar. 15, 2011

(54) METHOD OF PRODUCING A HEAT EXCHANGER MODULE

(75) Inventors: Christian Riondet, Bourgogne (FR); Florent Travers, Reims (FR); Jens-Petter Arnesen, Reims (FR); Jean-Marc Lesueur, Reims (FR); Alain Bauerheim, Jonchery sur Vesle (FR); Alexandre Sanchis, Barcelona (ES)

(73) Assignee: Valeo Systemes Thermiques S.A.S., Le Mesnil Saint Denis (FR)

( * ) Notice: Subject to any disclaimer, the term of this patent is extended or adjusted under 35 U.S.C. 154(b) by 1192 days.

(21) Appl. No.: 10/539,991

(22) PCT Filed: Dec. 16, 2003

(86) PCT No.: PCT/FR03/03750

§ 371 (c)(1),
(2), (4) Date: May 11, 2006

(87) PCT Pub. No.: WO2004/065872

PCT Pub. Date: Aug. 5, 2004

(65) Prior Publication Data

US 2006/0249277 A1 Nov. 9, 2006

(30) Foreign Application Priority Data

Dec. 23, 2002 (FR) ..... 02 16740

(51) Int. Cl.
*F28F 13/00* (2006.01)
*F28D 1/00* (2006.01)
*B21D 53/06* (2006.01)

(52) U.S. Cl. ..... 165/135; 165/149; 165/81

(58) Field of Classification Search ..... 165/140, 165/149, 135, 81, 82; 29/890.047
See application file for complete search history.

(56) References Cited

U.S. PATENT DOCUMENTS

| | | | | |
|---|---|---|---|---|
| 5,992,514 | A * | 11/1999 | Sugimoto et al. | 165/135 |
| 6,213,196 | B1 * | 4/2001 | Ozaki et al. | 165/140 |
| 6,237,676 | B1 * | 5/2001 | Hasegawa et al. | 165/67 |
| 6,354,368 | B1 * | 3/2002 | Nishishita et al. | 165/135 |
| 6,408,939 | B1 * | 6/2002 | Sugimoto et al. | 165/140 |
| 6,662,861 | B2 * | 12/2003 | Ozaki et al. | 165/140 |
| 6,871,399 | B2 * | 3/2005 | Iwasaki et al. | 29/890.03 |
| 2001/0022220 | A1 * | 9/2001 | Ozaki et al. | 165/135 |
| 2002/0029869 | A1 * | 3/2002 | Kodumudi et al. | 165/81 |
| 2003/0075307 | A1 * | 4/2003 | Stoynoff et al. | 165/135 |

* cited by examiner

*Primary Examiner* — Tho V Duong
(74) *Attorney, Agent, or Firm* — Howard & Howard Attorneys PLLC

(57) ABSTRACT

The invention relates to a heat exchange fin, particularly for cooling, consisting of a strip (30) comprising a first heat-exchange zone (18), intended to collaborate with tubes of a first heat exchanger, and a second heat-exchange zone (20), intended to collaborate with tubes of a second heat exchanger. According to the invention, said strip comprises a zone of weakness (22) able to allow it to be parted into a first element (64) comprising said first heat-exchange zone (18) and a second element (66) comprising said second heat-exchange zone (20).
The invention also relates to a heat-exchange module comprising such a fin and to a method of producing such a module.

3 Claims, 4 Drawing Sheets

Fig. 1
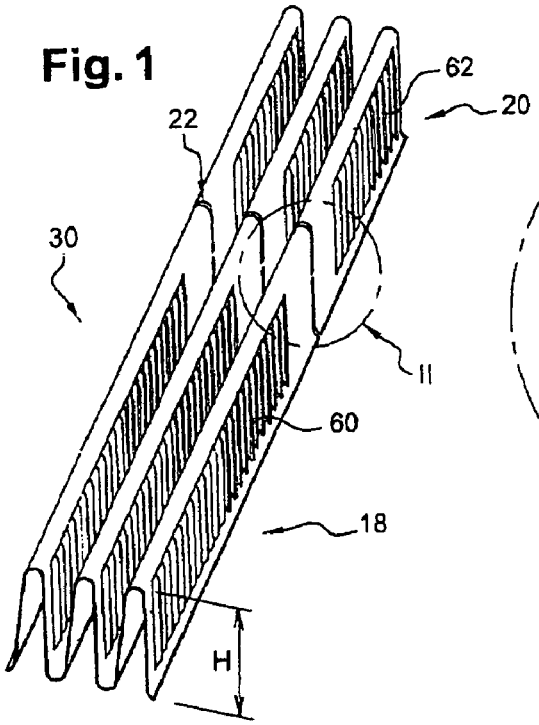
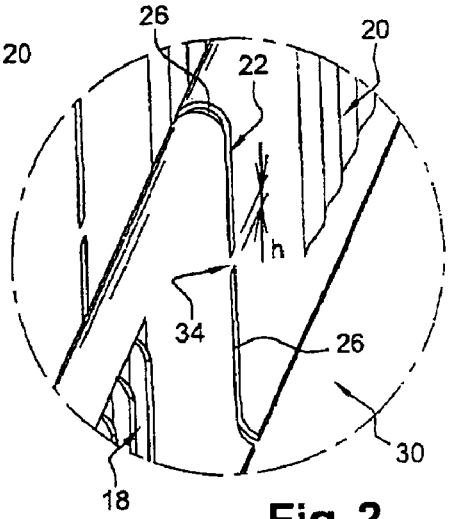
Fig. 2
Fig. 3
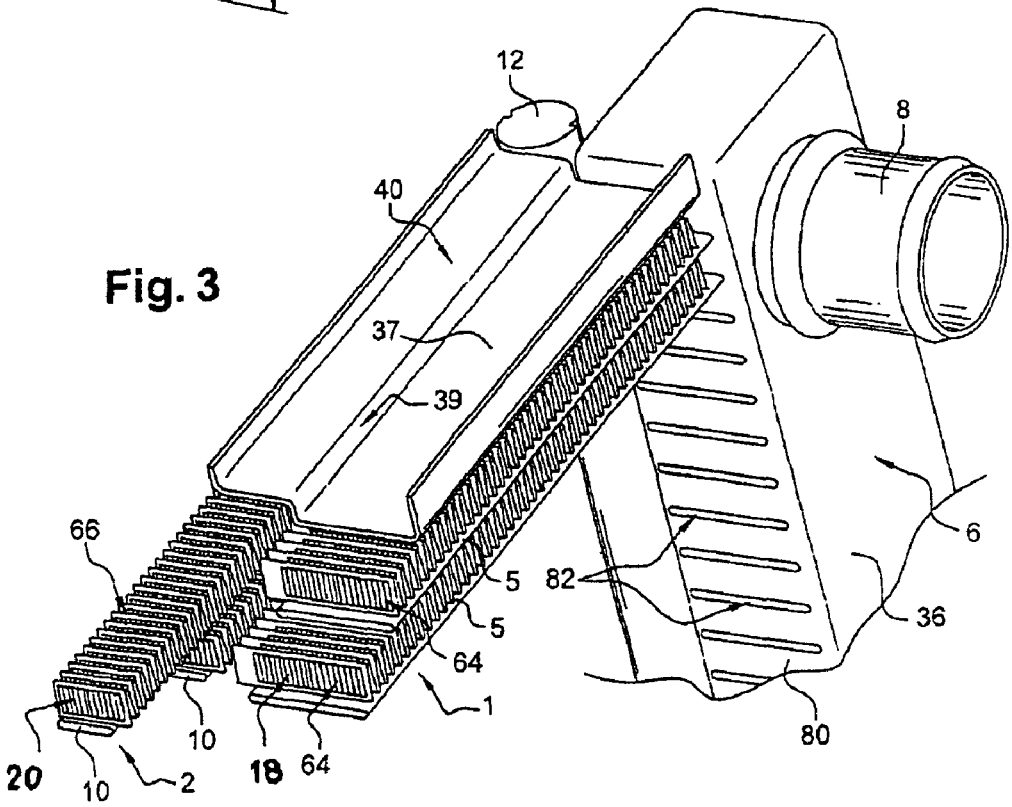

METHOD OF PRODUCING A HEAT EXCHANGER MODULE

BACKGROUND OF THE INVENTION

1. Field of the Invention

The invention relates to a heat-exchange fin, particularly for cooling, to a heat-exchange module comprising such a fin and to a method of producing such a module. It finds its applications in the field of motor vehicles in particular.

It relates more particularly to a heat-exchange fin, particularly for cooling, consisting of a strip comprising a first heat-exchange zone, intended to collaborate with tubes of a first heat exchanger, and a second heat-exchange zone, intended to collaborate with tubes of a second heat exchanger.

2. Description of the Related Art

It is known practice for such fins to be used in heat-exchange modules, also known as multi-exchangers, comprising at least a first and a second exchanger having at least one common component, each exchanger comprising fluid-circulation tubes, generally flat and uniformly spaced, with which each of the heat-exchange zones of the fins collaborates.

In such modules, it is necessary to avoid thermal bridges between the exchangers. This need is all the more keenly felt when the two exchangers are operating at different temperatures. By way of example, mention may be made of heat-exchange modules in motor vehicles which comprise a radiator used to cool the engine and a condenser forming part of the air-conditioning circuit.

The reduction in thermal bridges is conventionally achieved through various means, such as by making localized slots, removing material or a local reduction in the thickness of the fins. These various means, although they reduce exchanges of heat, do not, however, provide perfect thermal insulation, such as would be achieved in the absence of any thermal bridge.

SUMMARY OF THE INVENTION

The precise object of the invention is a heat-exchange fin which remedies these disadvantages by making it possible to eliminate the thermal bridge between the various exchangers of a heat exchanger module.

This object is achieved, in accordance with the invention, in that the strip constituting said fin comprises a zone of weakness able to allow it to be parted into a first element comprising said first heat-exchange zone and a second element comprising said second heat-exchange zone.

By virtue of these features, a fin is available which allows the simultaneous assembly of the components of two exchangers, then allows the link between said first and second exchange zones to be parted.

In this way it is possible to obtain multi-exchangers which offer the advantage of having no thermal bridge between the heat-exchange zones of the fin because there is no longer between them any residual metallic link via which heat could be transferred.

According to an advantageous embodiment, the strip of the fin according to the invention has a corrugated shape and said zone of weakness consists of a straight slot, for example obtained by shearing, interrupted at some of the faces of the corrugations by at least one residual link provided between said first and said second heat-exchange zones.

By way of example, the faces of the corrugations have a height H and said residual link, provided mid-way along, has a height h of between H/5 and H/30, particularly of about 0.5 mm.

According to a variant, the fins are flat. They then comprise perforations into which the tubes are introduced.

The invention also relates to a heat-exchange module comprising at least a first and a second heat exchanger, each exchanger comprising fluid-circulation tubes, generally flat, uniformly spaced, having a width, characterized in that it comprises fins as described above, said first and second elements of said fins, designed separated from each other, being associated with the tubes of the first and of the second exchanger respectively.

Said strip has a width, for example, more or less equal to the sum of the widths of the tubes of the first and second exchangers while said first and second heat-exchange zones of said strip have a width corresponding to the width of the tubes of the first and of the second exchanger respectively.

According to a first embodiment, this may be a heat-exchange module with no common component. The exchangers will then be secured to one another by added-on elements.

According to another embodiment, this may be a multi-exchanger. More specifically, said module may further comprise at least one cheek assembled by brazing with the first heat-exchange zone and with the second heat-exchange zone.

In a first example, the tubes of the exchangers of said multi-exchanger are offset from one another in a direction orthogonal to said tubes and said cheeks have an equivalent offsetting level between the first and second exchangers.

In a second example, said cheeks comprise two parts joined together by deformable links and assembled by brazing to the first and to the second heat-exchange zones respectively.

In such an example, one of the parts of the cheek assembled with one of the heat-exchange zones may comprise at least one protrusion secured by brazing to the other heat-exchange zone.

It may also be noted that such cheeks are of positive benefit in any type of module without it necessarily having to be a series of modules equipped with fins according to the invention. This is because, through their structure, these cheeks have the ability to limit the transfer of heat from one exchanger to the other.

The invention also relates to a method of producing a heat-exchange module comprising at least two heat exchangers, each exchanger comprising fluid-circulation tubes, generally flat and uniformly spaced, having a width, and cooling elements associated with these tubes, characterized in that:

- strips of sheet metal are provided,
- the strips of sheet metal are weakened in such a way as to limit a first heat-exchange zone intended to be associated with the tubes of the first exchanger and a second heat-exchange zone intended to be associated with the tubes of the second heat exchanger, this weakening leaving a residual link remaining between the first heat-exchange zone and the second heat-exchange zone,
- the strips of sheet metal are associated with the tubes of the exchangers,
- the residual links between the first heat-exchange zone and the second heat-exchange zone are broken so as to separate the zones entirely,
- the exchangers are assembled by brazing.

Having produced said weakness, said strip of sheet metal constitutes, for example, a fin as defined above.

Advantageously, the operation of breaking the residual links is performed before the brazing at the time of the operation of associating the strips of sheet metal with the tubes.

As a preference, the strips of sheet metal are shaped in such a way as to give them a corrugated shape, the strips of sheet metal being associated with the tubes of the exchanger by introducing corrugated strips of sheet metal between the tubes.

In this case, the corrugated inserts of all the exchangers of the heat-exchange module are produced in a single operation and this makes it possible to improve the speed of production without at the same time increasing the forming rate. As a result, the geometric characteristics of the inserts can be kept within tight manufacturing tolerances, and this makes them easier to introduce between the tubes without problems of matching.

Advantageously, said residual link is formed at the time of the shaping of the strips of sheet metal into a corrugated shape, by producing a discontinuous slot in the strips of sheet metal, for example by shearing.

Alternatively, the strips of sheet metal may be weakened by removing material or by making longitudinal slots, prior to shaping.

Advantageously, the residual links are broken by moving the exchangers one relative to the other, particularly in a shearing movement.

In the case of the production of modules of the multi-exchanger type with common cheeks, if these are flat non-deformable cheeks, they may be assembled with the first and second heat zones after the latter have been parted.

In the case of deformable cheeks like those mentioned above, they may be assembled with the rest of the module during the association of the tubes and of the strips of sheet metal exhibiting the heat-exchange zones. This is because, by virtue of their deformable nature, they will be able to withstand the operation of parting said heat-exchange zones.

In the case of a multi-exchanger with offset tubes, equipped with cheeks that have an offset equivalent to that of the tubes, one of the cheeks may be positioned against the heat-exchange zone of one of the exchangers and the other against the heat-exchange zone of the other exchanger, at the time of association of the tubes with the strips of sheet metal. Said cheeks will then be moved in two opposite directions in order thereby to obtain the desired offsetting of the tubes and the breakage of the residual link between the heat-exchange zones.

BRIEF DESCRIPTION OF THE DRAWINGS

Other characteristics and advantages of the present invention will become further apparent from reading the description which follows of some exemplary embodiments given by way of illustration with reference to the attached figures. In these figures:

FIG. 1 is a partial view in perspective of a fin according to the invention;

FIG. 2 illustrates a detail of the zone identified II in FIG. 1;

FIG. 3 is a perspective view of a module according to the invention;

DETAILED DESCRIPTION OF THE INVENTION

Figure 4:
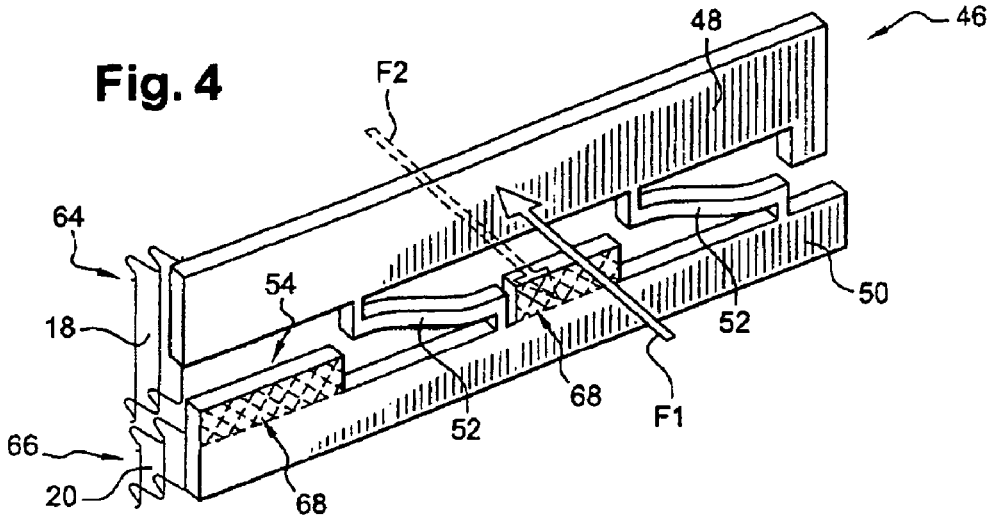
FIG. 4 is a perspective illustration of an alternative form of embodiment of an element in a module according to the invention.

FIGS. 1 and 2 depict a heat-exchange fin, particularly for cooling, according to the invention. Said fin consists of a strip 30 comprising a first heat-exchange zone 18, intended to collaborate with tubes of a first heat exchanger, and a second heat-exchange zone 20, intended to collaborate with tubes of a second heat exchanger. Such fins are able to perform an exchange of heat between the air and a fluid circulating through the tubes. They are, for example, made of aluminum.

Each heat-exchange zone 18, 20 may be equipped with means for disturbing the flow of air, also known as louvers 60, 62, known to those skilled in the art.

Advantageously, the configuration of said louvers is adapted to suit the type of exchanger equipped. They may, for example, be orientated top-to-tail on either side of an axis of symmetry, this being in each heat-exchange zone 18, 20. In other words, in the first heat-exchange zone 18 there are, on each side of a first axis of symmetry, louvers of opposed orientations. Likewise, in the second heat-exchange zone 20, on each side of a second axis of symmetry. The number of louvers in the first heat-exchange zone and that of the second heat-exchange zone may differ.

According to the invention, said strip comprises a zone of weakness 22 able to allow it to be parted into a first element comprising said first heat-exchange zone 18 and a second element comprising said second heat-exchange zone 20.

It will be noted that the widths of the zones 18 and 20 are not necessarily equal. The width of each of these zones corresponds to the width of the fluid-circulation tubes of each of the exchangers with which the fin is intended to collaborate. If the tubes of the first exchanger are wider than the tubes of the second exchanger then the heat-exchange zone 18 intended to establish an exchange of heat with the tubes of the first exchanger may be wider than the heat-exchange zone 20 intended to establish an exchange of heat with the tubes of the second exchanger. The zone of weakness 22 of the fin may thus be offset from the axis of symmetry thereof.

According to the embodiment illustrated, said strip 30 has a corrugated shape and said zone of weakness 22 consists of a rectilinear slot interrupted at some of the faces of the corrugations by at least one residual link 34 provided between said first and said second heat-exchange zones. The ratio of the number of faces with a residual link to the number of faces with no residual link may vary between 1/7 and 1/20. It may, in particular, be 1/10.

The two heat-exchange zones 18 and 20 are thus separated from one another by slits 26 interrupted at regular intervals by tabs of sheet metal 34, particularly perpendicular to the longitudinal axis of the strip of sheet metal 30.

The strip of sheet metal is thus weakened, this weakening leaving residual links consisting of the tabs remaining between the first heat-exchange zone 18 and the second heat-exchange zone 20. Said slits have, for example, a width of less than 0.5 mm, even 0.3 mm, even 0.1 mm, or alternatively a zero or non-measurable width, said weakening resulting from a simple cut without the removal of material.

The faces of the corrugations have, in particular, a height H and said residual link has a height h of, for example, between H/5 and H/30, particularly equal to H/12. It may be provided mid-way along the height, or in the radii.

The heat-exchange module depicted in FIG. 3 consists of a radiator 1 for cooling the engine of a motor vehicle and of an air-conditioning condenser 2, these two exchangers generally being flat.

The radiator 1 is made up in a known way of a bundle of fluid-circulation tubes 5 mounted between two header boxes 6 (just one box has been depicted), the two header boxes 6 being arranged along the two parallel sides of the tube bundle and equipped with an inlet 8 and outlet nozzle for the cooling fluid.

The condenser 2 is also made up of a bundle of fluid-circulation tubes 10 mounted between two header boxes 12 (just one box has been depicted), the header boxes being arranged along two parallel sides of the bundle and equipped with inlet and outlet nozzles (not depicted) for the refrigerating fluid.

The tubes of each of the exchangers are, for example, made of aluminum.

According to the invention, said module also comprises fins as described above, said first and second elements 64, 66 of said fins designed separate, being respectively associated with the tubes 5, 10 of the first and of the second exchangers. The line of the broken residual link 34, although visible, has not been depicted.

In the embodiment depicted, the fins of the heat-exchange module consist of corrugated sheet metal inserts arranged between the tubes 5 and the tubes 10.

The header box 6 of the exchanger 1 is formed of metal sheets, advantageously made of aluminum, shaped using conventional cutting and pressing operations. They comprise an end wall 80 which is generally flat and of elongate rectangular shape. This end wall is intended to constitute the manifold plate, also known as the "tube plate", of the header box 6. For this purpose it comprises a plurality of spaced-apart holes 82 of elongate shape intended to receive the tubes 5 of the exchanger 1. The header box 6 also comprises bent-over opposing sidewalls 36 which are generally flat and mutually parallel. The sidewalls 36 meet the end wall more or less at right angles along two fold lines which are mutually parallel. The nozzle 8 is formed in one of the sidewalls 36.

The header box 6 is closed by a metal tape of given width which has parallel generatrices. This tape may fit in between the sidewalls 36 of the header box 6 to form an assembly ready to be brazed at the same time as the nozzle 8.

The header box 12 of the exchanger 2 has the overall shape of an elongate cylinder equipped with perforations intended to accept the tubes 10 of the exchanger.

Advantageously, said heat-exchange module according to the invention further comprises at least one cheek 40 assembled by brazing with the first heat-exchange zone 18 and with the second heat-exchange zone 20. Said cheek is made, for example, of a metal plate 37 of rectangular overall shape.

According to the embodiment illustrated, the tubes 5, 10 of the exchangers are offset from one another in a direction orthogonal to said tubes and the cheeks 40 have an equivalent offset 39 in level between the first and second exchangers 1, 2.

As illustrated in FIG. 4, according to another embodiment, the module comprises deformable lateral cheeks 46. For that, said cheeks comprise two parts 48, 50 joined together by deformable links 52 and assembled by brazing with the first 18 and the second 20 heat-exchange zones respectively.

More precisely, the cheek 46 comprises two adjacent elongate parts, namely a part 48 and a part 50, which are joined together by the deformable links 52. The part 48 is able to be assembled with the first heat-exchange zone 18, that is to say with the inserts of the exchanger 1, while the part 50 is able to be assembled with the second heat-exchange zone 20, that is to say with the inserts of the exchanger 2.

One of the parts 50 of the cheek assembled with one of the heat-exchange zones 20 comprises at least one protrusion 68 secured by brazing to the other heat-exchange zone 18.

The invention also relates to a method of producing a heat-exchange module comprising at least two heat exchangers 1, 2, each exchanger comprising fluid-circulation tubes 5, 10, generally flat and uniformly spaced, having a width, and cooling elements 64, 66 associated with these tubes 5, 10.

According to the invention, the following operations are performed:

strips of sheet metal 30 are provided, the strips of sheet metal 30 are weakened 22 in such a way as to limit a first heat-exchange zone 18 intended to be associated with the tubes 5 of the first exchanger 1 and a second heat-exchange zone 20 intended to be associated with the tubes 10 of the second heat exchanger 2, this weakening leaving a residual link 34 remaining between the first heat-exchange zone 18 and the second heat-exchange zone 20, the strips of sheet metal 30 are associated with the tubes 5 and 10 of the exchangers 1, 2, the residual links 34 between the first heat-exchange zone 18 and the second heat-exchange zone 20 are broken so as to separate the zones entirely, the exchangers 1, 2 are assembled by brazing.

Having produced said weakness, said strip of sheet metal constitutes, for example, a fin as defined above.

Advantageously, prior to assembly, the strips of sheet metal 30 are shaped in such a way as to give them a corrugated shape, the strips of sheet metal 30 being associated with the heat-exchange tubes by introducing the strips of sheet metal between the tubes 5, 10.

Figure 5:
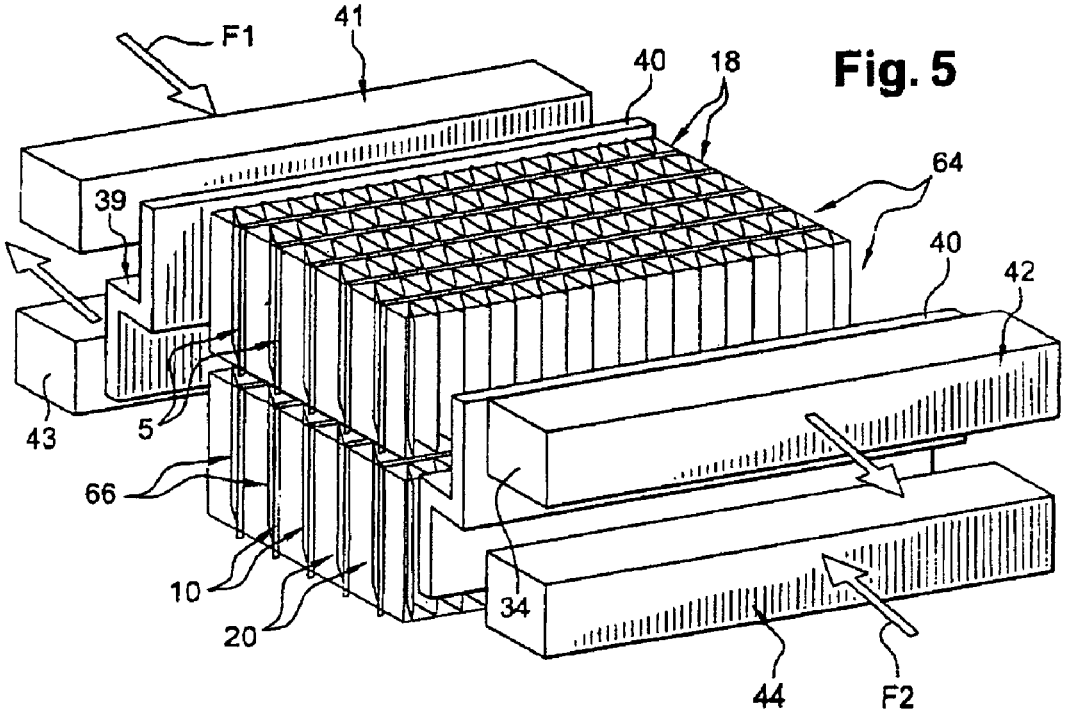
FIG. 5 is a perspective illustration of a step in a method, according to the invention, of producing a heat exchanger module.

FIG. 5 schematically depicts the operation of associating the fins with the tubes. As illustrated, the operation of breaking the residual links 34 of said fins may be performed during this step.

More specifically, after inserting the corrugated fins 30 between the tubes 5 and the tubes 10, the heat-exchange zone 18 and the heat-exchange zone 20 are still joined together by the tabs of sheet metal 34.

The residual links 34 may be broken by moving the exchangers 1, 2 one relative to the other. More specifically, the heat-exchange zones 18 and 20 may be parted by a shearing movement by exerting a force in a first direction F1 on the first exchanger and a force in a second direction F2 parallel to and the opposite of the direction F1, on the second exchanger.

Such an operation may be performed by tooling comprising a pair of jaws 41 and 42 able to grip the heat-exchange zone 18 (tubes 5 and heat-exchange elements 64) of the heat exchanger 1, and another pair of jaws 43 and 44 able to grip the heat-exchange zone 20 (tubes 10 and heat-exchange elements 66) of the heat exchanger 2, said pairs of jaws being able to move in the directions F1, F2.

Said residual link 34 is, for example, produced by making a discontinuous slot in the strips of sheet metal 30 at the time that they are being shaped into a corrugated shape.

Advantageously, there is a cheek 40 common to the two opposing exchangers of the first 18 and second 20 heat-exchange zones and said exchangers 1, 2 are assembled with one another via said cheek at the time of brazing.

Figure 6:
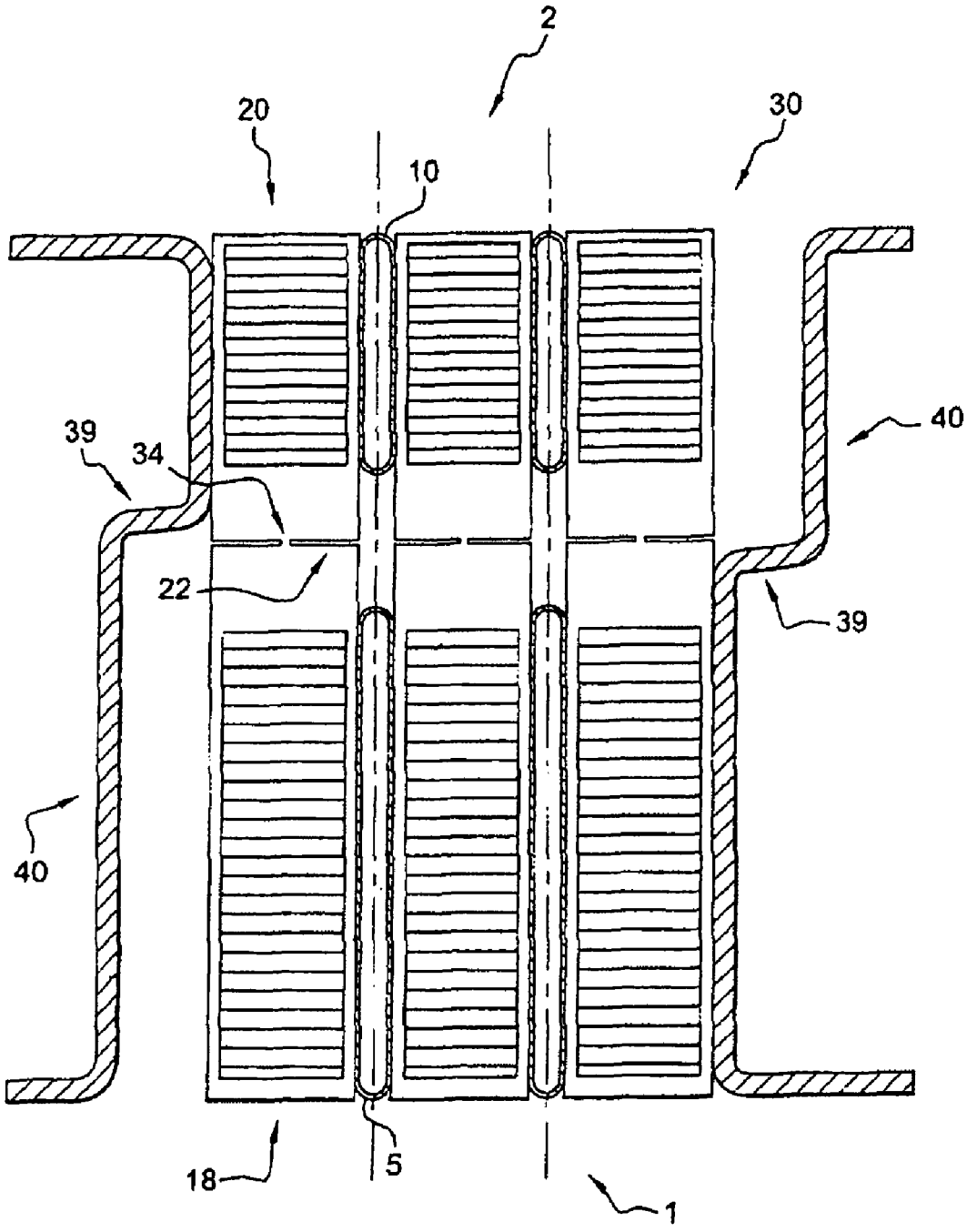
FIG. 6 details, in cross section, the relative position of the various components illustrated in FIG. 5, in a first state.
Figure 7:
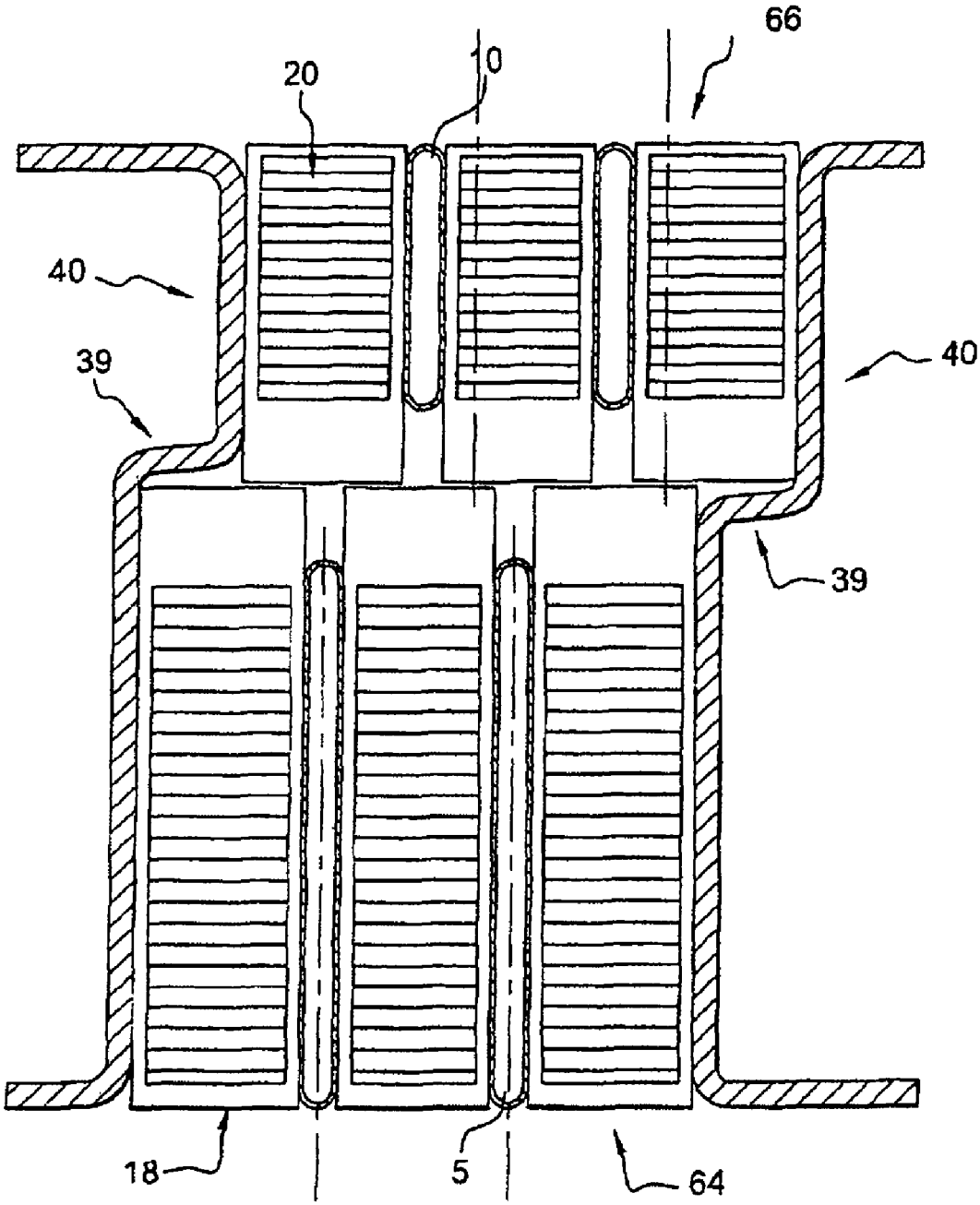
FIG. 7 details, in cross section, the relative position of the various components illustrated in FIG. 5, in a second state.

As illustrated in FIGS. 6 and 7, according to a first embodiment, these are cheeks exhibiting an offset 39.

One of the cheeks may then be positioned against the heat-exchange zone 18 of one of the exchangers 1 and the other cheek 40 against the heat-exchange zone 20 of the other exchanger 2, when the tubes 5, 10 and the strips of sheet metal 30 are being associated, as more particularly illustrated in FIG. 6.

Said cheeks are then forced in two opposite directions thereby obtaining the desired offset for the tubes and breaking the residual link between the heat-exchange zones. The cheeks 40 then bear against the heat-exchange elements 64, 66 across their entire width, as illustrated in FIG. 7.

According to another embodiment, this may be a deformable cheek like the one described in FIG. 5.

In this case, the deformable links 52 may have been obtained beforehand by virtue of cuts 54 made in the thickness of the metal sheet.

The two parts 48 and 50 of the cheek are then assembled pressed against the fins 30 before the residual linking zones of the heat-exchange zones 18, 20 are broken.

When the residual linking zones 34 are broken to part the two heat-exchange zones 18 and 20, the parts 48 and 50 of the cheek remain secured to the two heat-exchange zones but find themselves separated from one another. However, these two parts 48 and 50 remain secured to one another by virtue of the deformable links 52.

Thus, in this embodiment, the cheek 46 is associated at the same time as the rest of the exchanger (tubes and fins) and, by virtue of its deformable links 52, absorbs the shearing movement produced by the parting of the two heat-exchange zones.

The invention is not restricted to the forms of embodiment described hereinabove by way of example and extends to cover other variants. Thus, instead of using header boxes made entirely of metal, use could be made of header boxes made of plastic, each one associated with a metal manifold.

Furthermore, the description here has related to a heat-exchange module comprising two heat exchangers 1 and 2 (for example a cooling radiator and a condenser) intended to have different fluids running through them.

Also falling within the scope of the invention is the production of a heat-exchange module, that may also be termed a multi-temperature exchanger, in which the exchangers 1 and 2 have the same fluid running through them, but at different temperatures in one exchanger compared to the other.

Alternatively, rather than forming a module comprising a common cheek, said exchangers may be secured to one another in the form of a module, after brazing, using added-on connecting means.

The invention finds a particular application in the production of heat-exchange modules for motor vehicles.

The invention claimed is:

1. A heat-exchange module comprising at least a first and a second heat exchanger (1, 2), each exchanger comprising fluid-circulation tubes (5, 10), generally flat, uniformly spaced, having a width; the module comprising:

a heat-exchange fin including a strip (30) comprising a first heat-exchange zone (18) intended to collaborate with tubes of a first heat exchanger, and a second heat-exchange zone (20) intended to collaborate with tubes of a second heat exchanger, the strip comprises a zone of weakness (22) able to allow the strip to be parted into a first element (64) comprising the first heat-exchange zone (18) and a second element (66) comprising the second heat-exchange zone (20);

the first and second elements (64, 66) of the fins, designed separated from each other, being associated with the tubes (5, 10) of the first and of the second exchanger respectively; and at least one cheek (46) comprising two parts (48, 50) joined together by deformable links (52) and assembled by brazing to the first (18) and second (20) heat-exchange zones respectively with one of the parts (50) of the cheek assembled with one of the heat-exchange zones (20) comprising at least one protrusion (68) secured by brazing to the other heat-exchange zone (18).

2. The module as claimed in claim 1, in which the strip (30) has a corrugated shape and the zone of weakness comprises a straight slot interrupted at some of the faces of the corrugations by at least one residual link (34) provided between the first and second heat-exchange zones.

3. The module as claimed in claim 2, in which the faces of the corrugations have a height H and the residual link, provided mid-way along, has a height h of between H/5 and H/30.

* * * * *